US010098477B2

(12) United States Patent
Flynn-Kirkpatrick

(10) Patent No.: US 10,098,477 B2
(45) Date of Patent: Oct. 16, 2018

(54) CUSHIONED CHOKE-SAFE PLAY MAT

(71) Applicant: Shelley Flynn-Kirkpatrick, New Castle, CO (US)

(72) Inventor: Shelley Flynn-Kirkpatrick, New Castle, CO (US)

( * ) Notice: Subject to any disclaimer, the term of this patent is extended or adjusted under 35 U.S.C. 154(b) by 8 days.

(21) Appl. No.: 15/365,467

(22) Filed: Nov. 30, 2016

(65) Prior Publication Data

US 2017/0196390 A1 Jul. 13, 2017

Related U.S. Application Data

(60) Provisional application No. 62/276,118, filed on Jan. 7, 2016.

(51) Int. Cl.
*A47D 15/00* (2006.01)

(52) U.S. Cl.
CPC ..... *A47D 15/003* (2013.01)

(58) Field of Classification Search
CPC ..... A47G 9/062; A47G 9/083; A47G 9/02; A47D 15/003
See application file for complete search history.

(56) References Cited

U.S. PATENT DOCUMENTS 3,534,961 A * 10/1970 Tiley ..... A63F 7/0628 273/108.21
5,035,013 A * 7/1991 Bloom ..... A47D 13/063 190/1
5,088,139 A * 2/1992 Bloom ..... A47D 13/063 190/1
5,601,900 A * 2/1997 Doscher ..... A47G 27/0212 238/14
5,930,854 A * 8/1999 O'Neill ..... A47D 13/063 135/135
6,455,123 B1 * 9/2002 Poe, Sr. ..... A47G 27/0212 15/215
6,554,277 B1 * 4/2003 Descamps ..... A63B 21/0088 273/109
6,684,422 B2 * 2/2004 LeFevre ..... A47G 9/0223 2/69

(Continued)

OTHER PUBLICATIONS

Pottery Barn Kids, "Critter Playmat", Nov. 8, 2011, web.archive.org/web/20111108174647/https://www.potterybarnkids.com/products/critter-playmat/, pp. 1-2.*

*Primary Examiner* — Eric J Kurilla

(57) ABSTRACT

The cushioned choke-safe play mat is an apparatus that provides a safe and comfortable area for the playing of young children or infants. The cushioned choke-safe play mate includes an enclosing cover, a cushioning layer, and a plurality of toys. The enclosing cover surrounds the cushioning layer, and the plurality of toys is fixed along the exterior of the enclosing cover. The enclosing cover includes an upper layer and a lower layer. The upper layer and the lower layer are perimetrically connected to each other. This engagement between the upper layer and the lower layer encloses around the cushioning layer. More specifically, the lower layer is beneath the cushioning layer and the upper layer is above the cushioning layer. Consequently, as a user rests on top of the upper layer, the user is comfortably resting on top of the cushioning layer while safely playing with the plurality of toys.

17 Claims, 13 Drawing Sheets

(56) References Cited

U.S. PATENT DOCUMENTS

| | | | | |
|---|---|---|---|---|
| 2002/0095725 | A1* | 7/2002 | Dix | A47D 15/00 5/482 |
| 2009/0253342 | A1* | 10/2009 | Oren | A47D 5/006 446/227 |
| 2010/0138996 | A1* | 6/2010 | Davis | A41D 1/205 5/485 |
| 2012/0020586 | A1* | 1/2012 | Gilbert | A45C 9/00 383/4 |
| 2012/0124740 | A1* | 5/2012 | Castle | A47D 15/003 5/420 |
| 2016/0309913 | A1* | 10/2016 | Peterson | A47D 9/005 |

* cited by examiner

CUSHIONED CHOKE-SAFE PLAY MAT

The current application claims priority to U.S. provisional application Ser. No. 62/276,118 filed on Jan. 7, 2016.

FIELD OF THE INVENTION

The present invention relates generally to a play mat that can be safely used by infants and young children. More specifically, the present invention limits the amount of choking hazards while maintaining a comfortable and entertaining environment.

BACKGROUND OF THE INVENTION

A parent has a choice between a variety of baby play mats. Baby play mats include foam mats, fabric mats, padded mats, mats attached to activity gyms, mats with built in pillows, and so on. One of the biggest concerns of a parent however is the danger that toys present to their children's safety. Though toy packaging indicates the minimum age that a child should be if playing with the toy, the child is not entirely free from danger. Yet, none of the aforementioned play mats offer the benefits of these features into one baby play mat while effectively creating a safe environment for children.

An objective of the present invention is a cushioned choke-safe play mat that provides all the comfort, support, and entertainment to infants. The present invention offers a variety of ornamental designs to reflect a plurality of sceneries, a plurality of cartoon and movie characters, and a plurality of designs meant for babies. The present invention allows a baby to rest and play in an area without parents having to worry about the baby creating a mess with the toys, choking on any of the toys, while being unable to rest comfortably on the mat. The present invention incorporates a variety of materials and toys that are integrated into the micro-fleece cover. Each aspect of the ornamental design is illustrated by the varying materials, toys, and seams.

DETAILED DESCRIPTION OF THE INVENTION

All illustrations of the drawings are for the purpose of describing selected versions of the present invention and are not intended to limit the scope of the present invention.

The present invention is a cushioned choke-safe play mat that provides a safe and comfortable area for playing. The present invention enhances the cognitive skills of a user and prevents the user from hitting the ground hard if he or she accidentally falls. The present invention comprises an enclosing cover 1, a cushioning layer 4, and a plurality of toys 5. A couple of the plurality of toys 5 is shown attached to the enclosing cover 1 in FIG. 8. The enclosing cover 1 protects the cushioning layer 4 also illustrated in FIG. 8. The cushioning layer 4 provides a soft padded area for a user to rest. The cushioning layer 4 is preferably made of a low resilience polyurethane foam material. The plurality of toys 5 entertains the user and enhances the user's cognitive skills. The plurality of toys 5 is not removable from the enclosing cover 1 so that each of the plurality of toys 5 do not present a choking hazard to babies or young children using the present invention.

Figure 1:
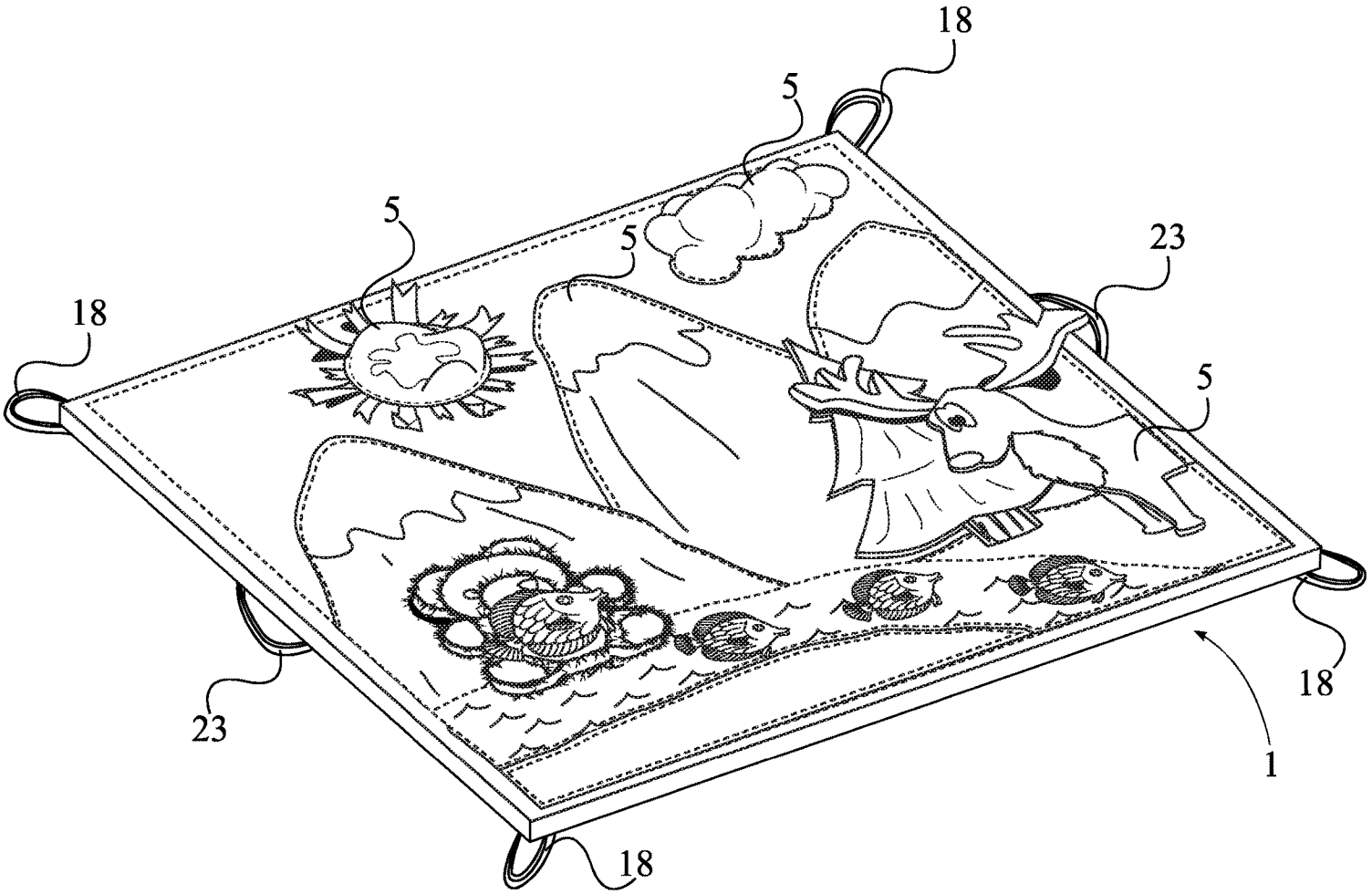
FIG. 1 is a top perspective view of the present invention.
Figure 7:
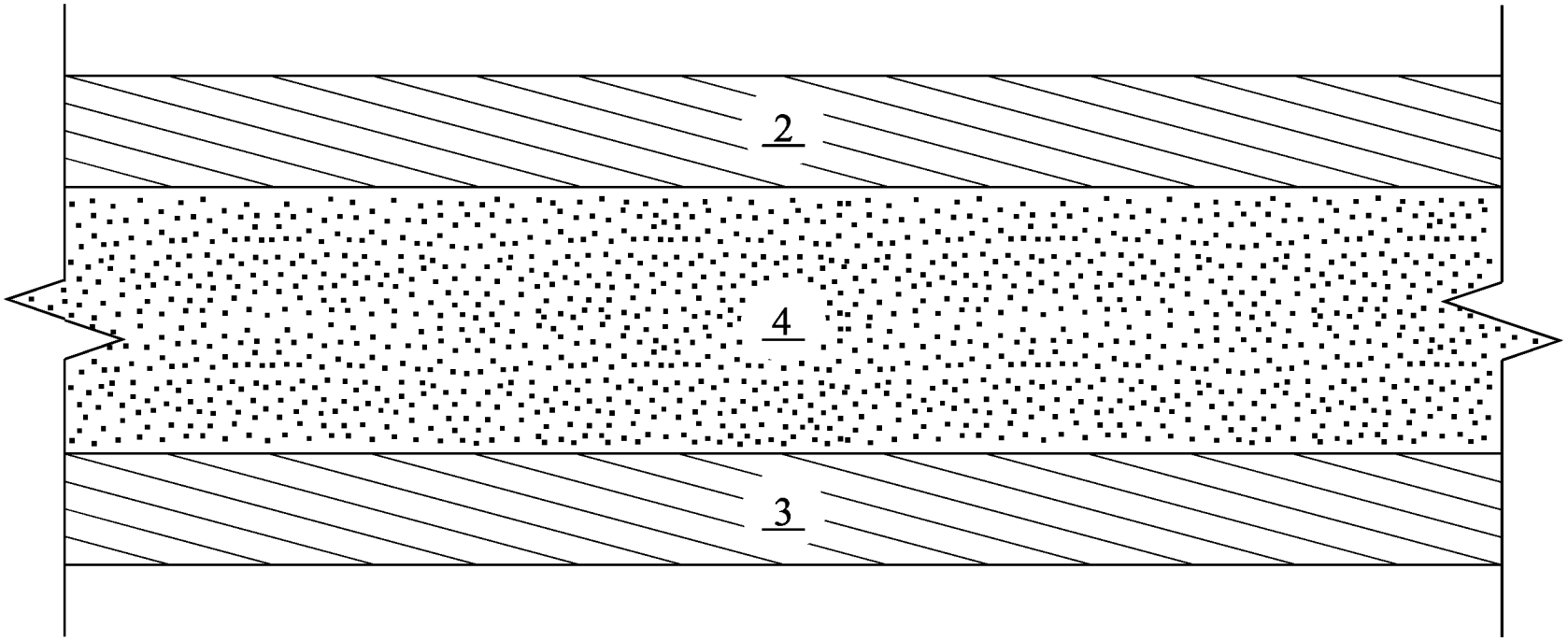
FIG. 7 is a schematic view of the enclosing cover and the cushioning layer of the present invention.

The general configuration of the aforementioned components provides a safe, entertaining environment for the user. The enclosing cover 1 prevents the cushioning layer 4 from being damaged as well as houses the cushioning layer 4. The enclosing cover 1 comprises an upper layer 2 and a lower layer 3. The upper layer 2 and the lower layer 3 are illustrated in FIG. 7. The upper layer 2 prevents the cushioning layer 4 from coming into direct contact with the user. The lower layer 3 prevents the cushioning layer 4 from coming into direct contact with the floor. The upper layer 2 and the lower layer 3 are perimetrically connected to each other, and the cushioning layer 4 is positioned within the enclosing cover 1. In addition, the cushioning layer 4 is superimposed onto the lower layer 3, and the upper layer 2 is superimposed onto the cushioning layer 4, as shown in FIG. 7. Thus, the configuration between the upper layer 2, the lower layer 3, and the cushioning layer 4 prevents the cushioning layer 4 from escaping the enclosing cover 1. The cushioning layer 4 is completely surrounded by the enclosing cover 1. The upper layer 2 provides a platform for the plurality of toys 5, which are fixed exterior and across the upper layer 2, as shown in FIG. 1. A user may rest on the cushioning layer 4 without coming into direct contact with the cushioning layer 4 while playing with the plurality of toys 5 as the upper layer 2 is superimposed onto the cushioning layer 4.

The plurality of toys 5 provides entertainment to a user while enhancing his or her cognitive skills. A variety of the plurality of toys 5 is shown in the perspective view of FIG. 1. The plurality of toys 5 comprises at least one stuffed toy 6. The at least one stuffed toy 6 is a plush item that the user may grab or hug while playing. The at least one stuffed toy 6 comprises a main cover 7 and a main filling 8. The main cover 7 protects the main filling 8. The main filling 8 creates a plush quality of the at least one stuffed toy 6. The main cover 7 is perimetrically connected to the upper layer 2, and the main filling 8 is positioned in between the main cover 7 and the upper layer 2. The attachment between the upper layer 2 and the main cover 7 contains the main filling 8 and allows a user to press upon the at the at least one stuffed toy 6.

Figure 10:
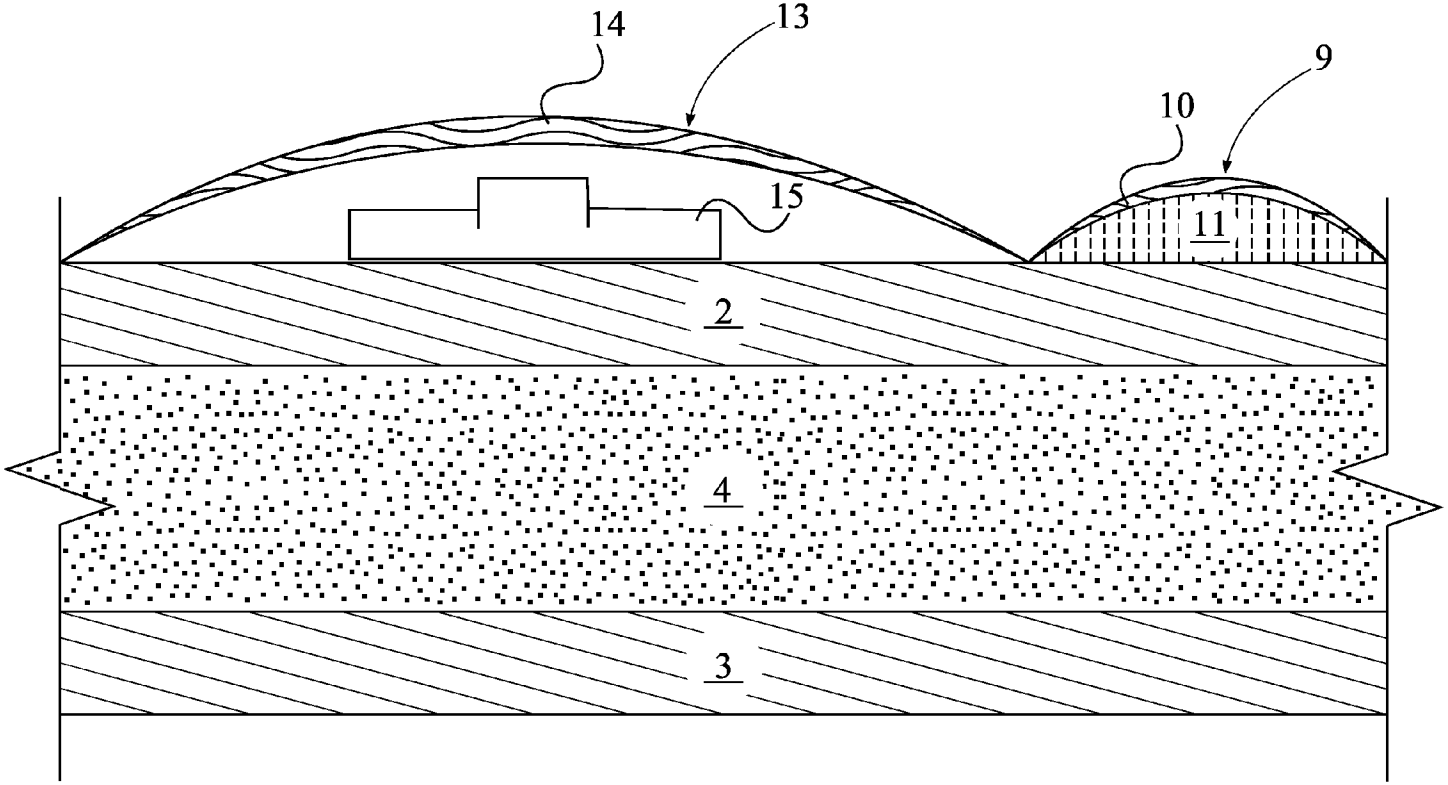
FIG. 10 is a schematic view of the enclosing cover, the cushioning layer, and an embodiment of the at least one squeaky toy of the present invention.
Figure 11:
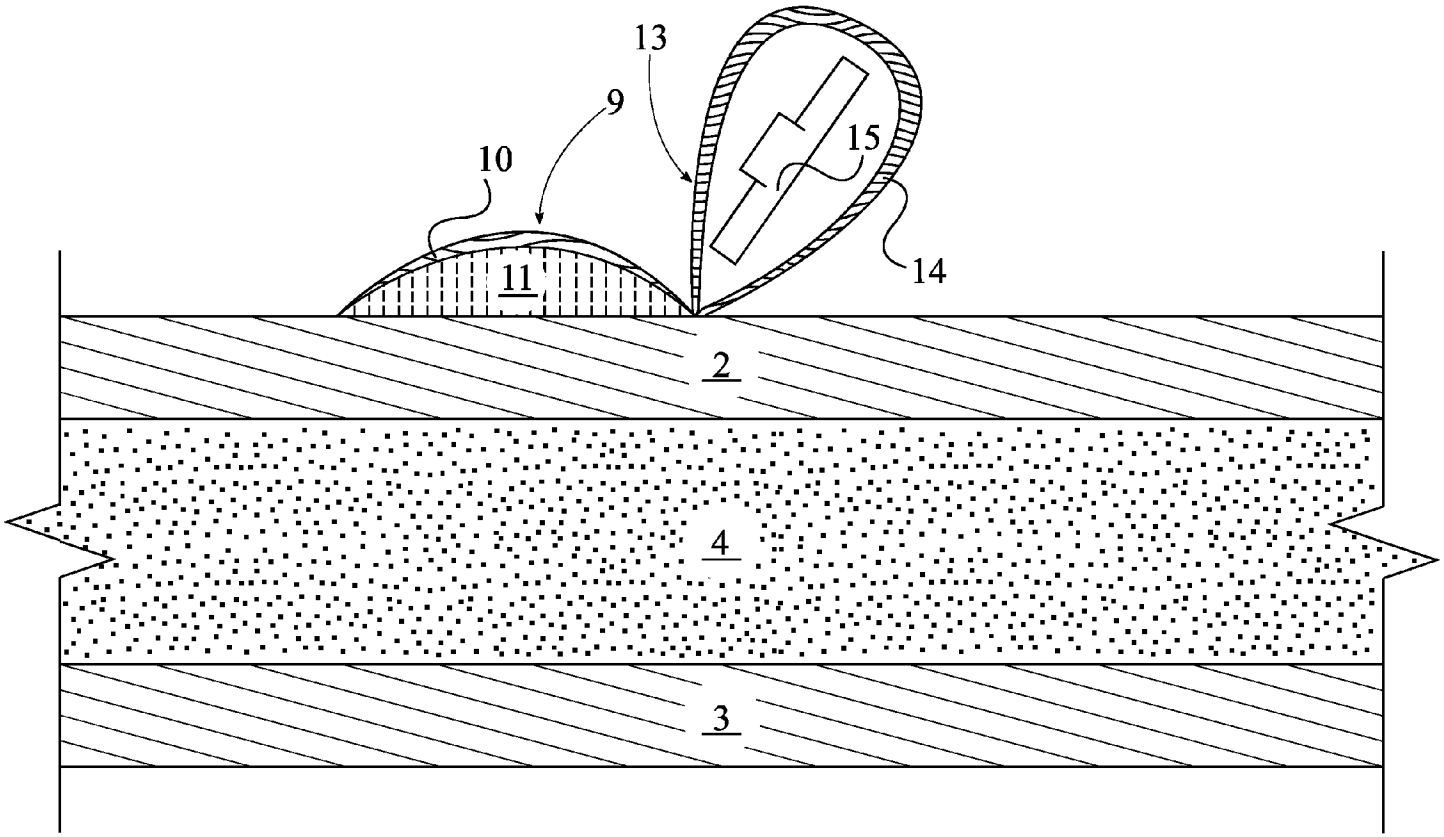
FIG. 11 is a schematic view of the enclosing cover, the cushioning layer, and an alternative embodiment of the at least one squeaky toy of the present invention.
Figure 12:
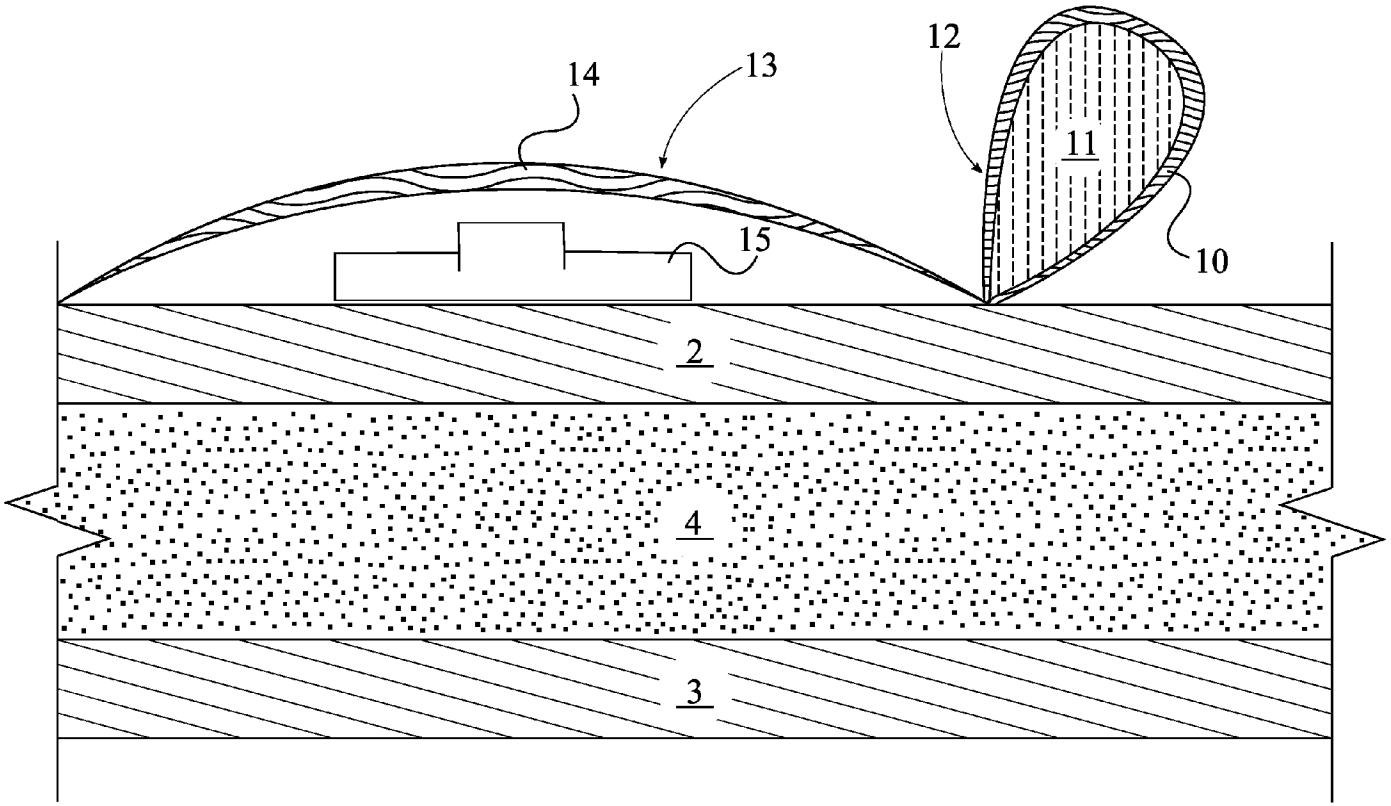
FIG. 12 is a schematic view of the enclosing cover, the cushioning layer, and an alternative embodiment of the at least one squeaky toy of the present invention.
Figure 13:
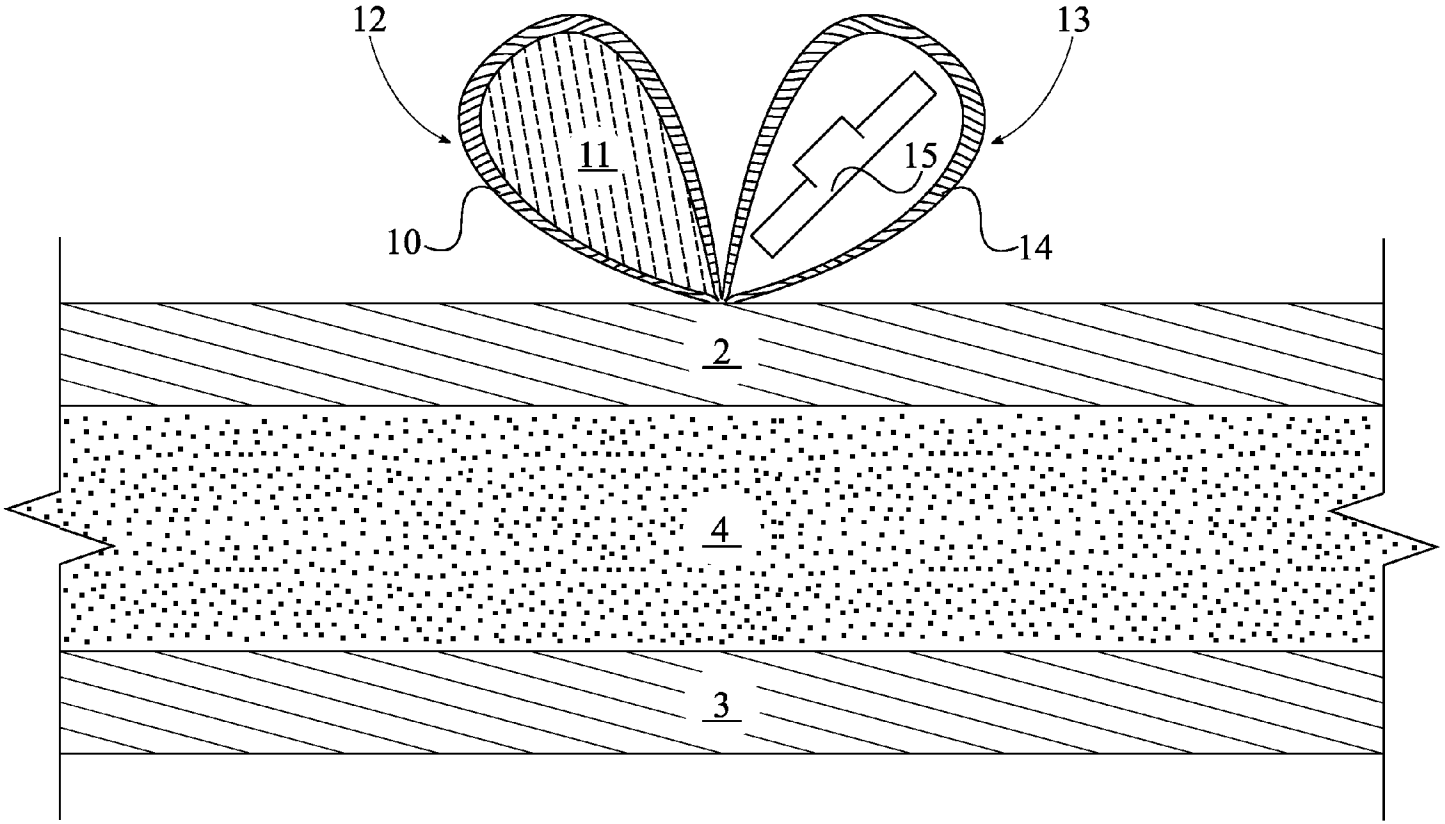
FIG. 13 is a schematic view of the enclosing cover, the cushioning layer, and an alternative embodiment of the at least one squeaky toy of the present invention.

The plurality of toys 5 further comprises at least one squeaky toy 13. The at least one squeaky toy 13 emits a sound upon the application of a force. A plurality of the at least one squeaky toy 13 is shown in FIG. 10, FIG. 11, FIG. 12, and FIG. 13. A first embodiment of the at least one squeaky toy 13 comprises a main cover 14 and a press-activated sound-emitting device 15. The main cover 14 protects the press-activated sound-emitting device 15. The main cover 14 is perimetrically connected to the upper layer 2. The main cover 14 secures the position of the press-activated sound-emitting device 15, as illustrated in FIG. 10. The press-actuated sound-emitted device 15 provides an auditory experience for the user. The press-actuated sound-emitting device 15 is positioned in between the main cover 14 and the upper layer 2. The attachment between the main cover 14 and the upper layer 2 prevents the unwanted movement of the press-activated sound-emitted device 15. Alternatively, a second embodiment of the at least one squeaky toy 13 similarly comprises a main cover 14 and a press-activated sound emitting device 15. The main cover 14 encloses the press-activated sound-emitting device 15 so that the press-activated sound-emitting device 15 remains attached to the enclosing cover 1. In addition, the main cover 14 is hingedly connected to the upper layer 2 so that the at least one squeaky toy 13 is flappable on the present invention, as shown in FIG. 11. The second embodiment of the at least one squeaky toy 13 allows the user to grab and squeeze entirely the at least squeaky toy 13 instead of pressing on one section of the first embodiment of the squeaky toy 13.

Figure 8:
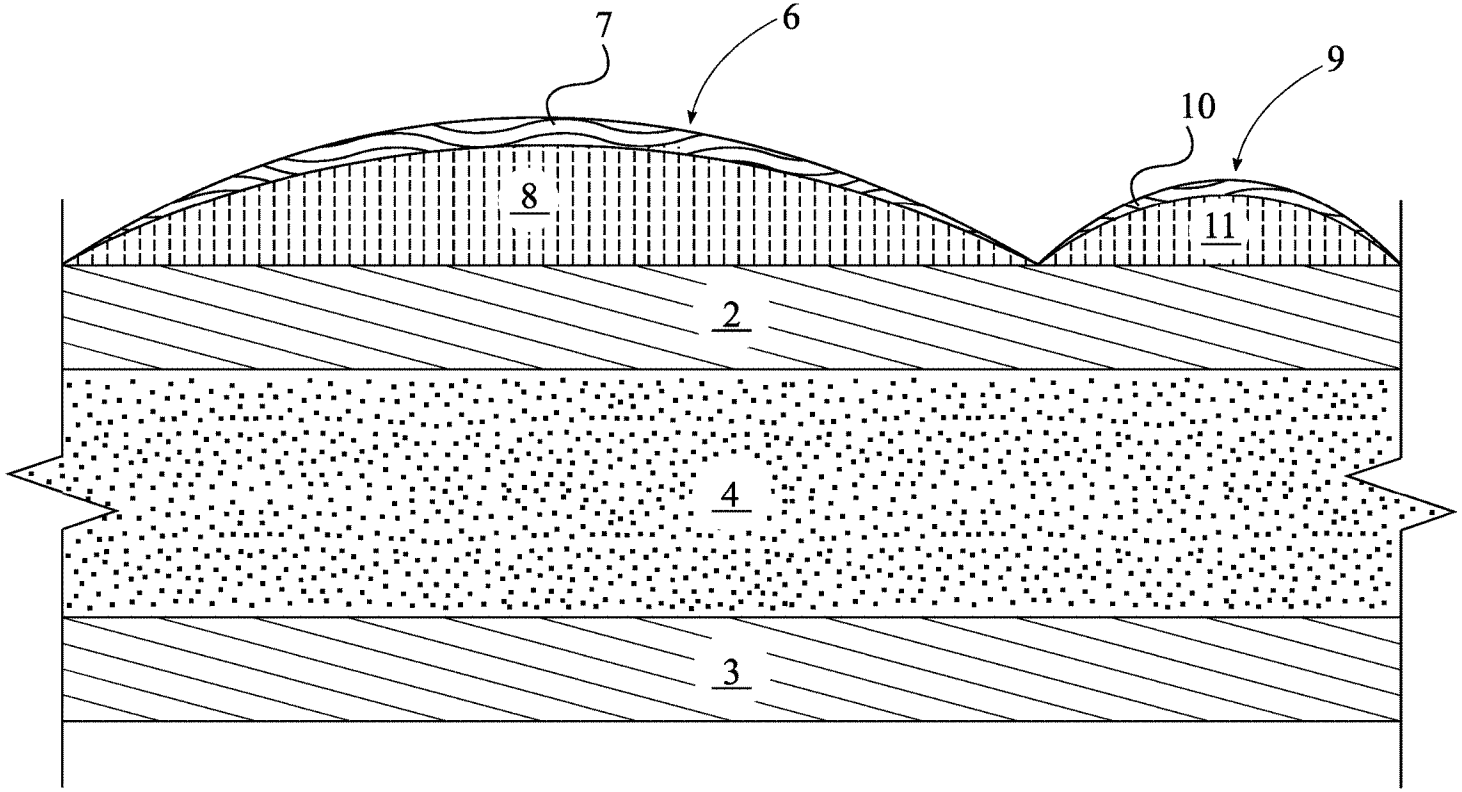
FIG. 8 is a schematic view of the enclosing cover, the cushioning layer, and an embodiment of the at least one stuffed toy of the present invention.
Figure 9:
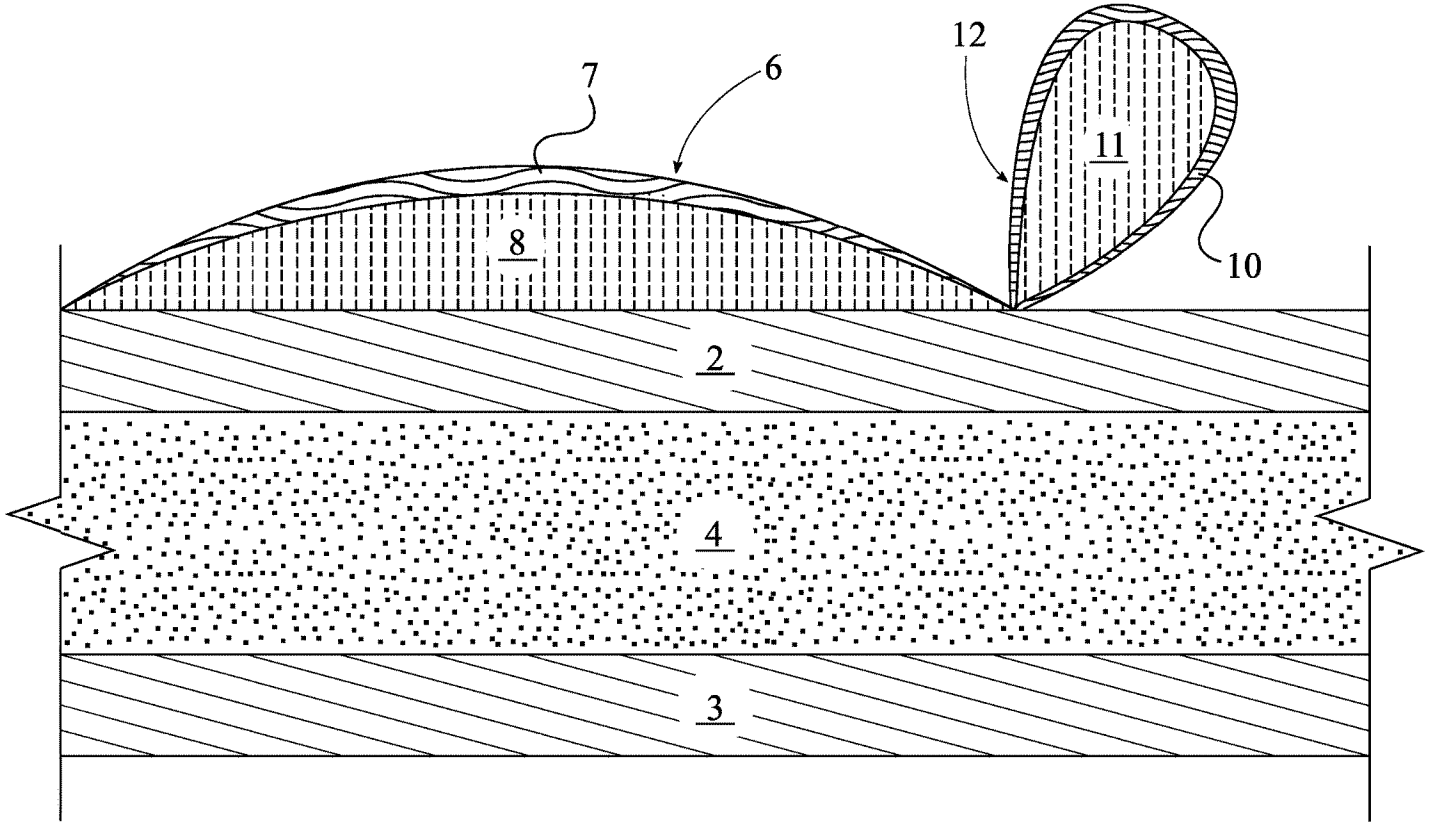
FIG. 9 is a schematic view of the enclosing cover, the cushioning layer, and an alternative embodiment of the at least one stuffed toy of the present invention.

The at least one stuffed toy 6, the first embodiment of the at least one squeaky toy 13, and the second embodiment of the at least one squeaky toy 13 may each comprise at least one secondary feature 23. The at least one secondary feature 9 is used to increase the variety of tactile and visual experiences that are available to the user of the present invention. One embodiment of the at least one secondary feature 23 comprises a secondary cover 10 and a secondary filling 11. The secondary cover 10 encloses the secondary filling 11. The secondary cover 10 is positioned adjacent the main cover 7 and is fixed onto the upper layer 2. The arrangement between the secondary cover 10 and the upper layer 2 secures the position of the secondary filling 11. The arrangement between each of the at least one stuffed toy 6, the at least one squeaky toy 13, or the second embodiment of the at least one squeaky toy 13 with that of its corresponding the secondary features 9 is shown in FIG. 8, FIG. 10, and FIG. 11, respectively. An alternate embodiment of at least one secondary feature 9 comprises a flaccid member 12. The flaccid member 12 is a plush extension of the at least one stuffed toy 6 that contributes to the overall aesthetic of the plurality of toys 5. The proximal end of the flaccid member 12 is positioned adjacent to the main cover 7 to better represent the animal, feature of nature, or the item the at least one toy represents. This configuration is illustrated in FIG. 9.

The plurality of toys 5 may further comprise at least one frilly toy 16. The at least one frilly toy 16 enhances the tactile experiences that the user has with the present invention. The at least one frilly toy 16 comprises a plurality of strips 17 which are used to represent the rays of the sun or the branches of a tree. The preferred embodiment of the present invention arranges the plurality of strips 17 such that the at least one frilly toy 16 resembles that of sun rays as illustrated in FIG. 1. The plurality of strips 17 can be, but is not limited to, ribbons, strands of yarn, strings, and a variety of other flexible elongated bodies. The plurality of strips 17 is arranged in an aesthetic configuration. More specifically, the proximal end of each of the plurality of strips 17 is fixed onto the upper layer 2 such that a three-dimensional effect of the imagery defined by the aesthetic configuration.

The present invention may further comprise a plurality of loops 18. The plurality of loops 18 allows the user to grab the extremities of the present invention and to position the present invention into a rolled configuration. Each of the plurality of loops 18 is peripherally positioned about the cushioning layer 4 and is laterally fixed to the enclosing cover 1, as shown in the perspective views FIG. 1, FIG. 2, and FIG. 3. The arrangement of the plurality of loops 18 around the cushioning layer 4 prevents the enclosing cover 1 and the cushioning layer 4 from escaping the rolled configuration. The rolled configuration allows the user to better store the present invention. In the preferred embodiment, the plurality of loops 18 is evenly distributed about the cushioning layer 4.

Figure 4:
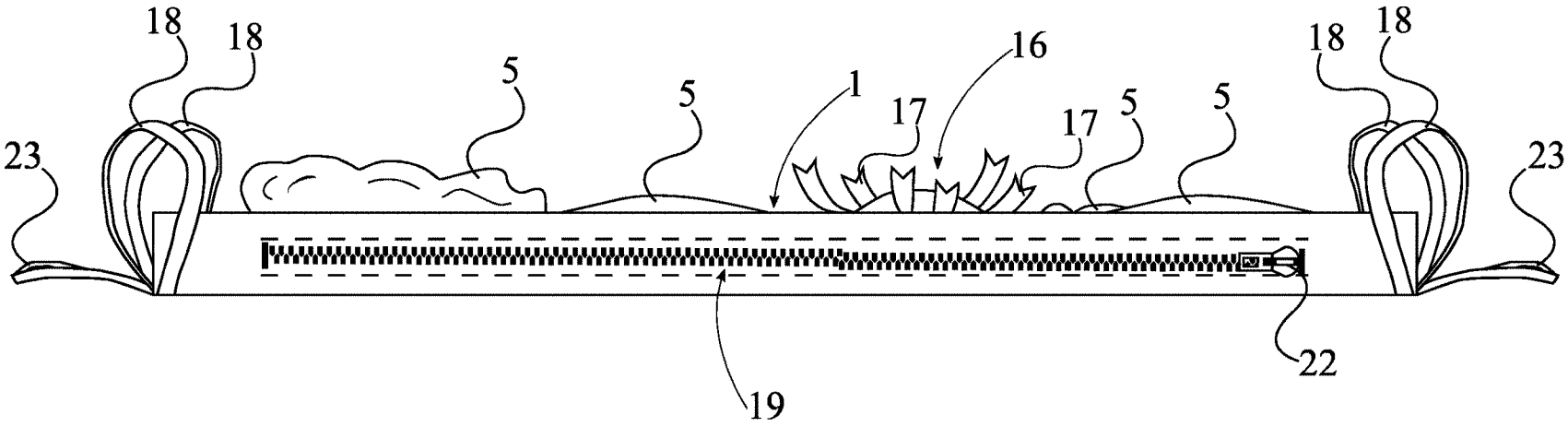
FIG. 4 is a front side view of the elongate fastener of the present invention.
Figure 5:
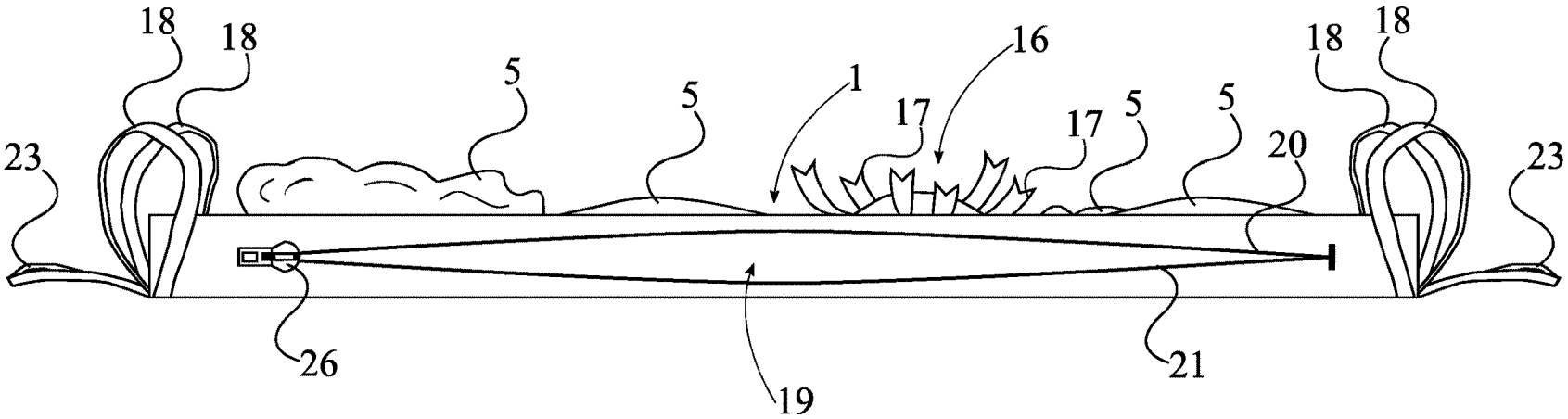
FIG. 5 is a front side view of the elongated opening of the present invention.

The present invention may further comprise an elongated opening 19 and an elongated fastener 22 which are integrated into the enclosing cover 1. The elongated opening 19 provides access into the enclosing cover 1, as illustrated in FIG. 5, and the elongated fastener 22 seals the elongated opening 19. The elongated opening 19 is sealed by the elongated fastener 22 in FIG. 4. The elongated opening 19 comprises a first lengthwise edge 20 and a second lengthwise edge 21. The first lengthwise edge 20 and the second lengthwise edge 21 define the elongated opening 19. The elongated opening 19 is positioned in between the upper layer 2 and the lower layer 3, as illustrated in FIG. 5. More specifically, the first lengthwise edge 20 and the second lengthwise edge 21 is attached along each other by the elongated fastener 22. The user may manually open and close the elongated opening 19 by engaging the elongated fastener 22. The elongated fastener 22 is preferably a zipper, however, alternate embodiments of the elongated fastener 22 may be a plurality of buttons, a plurality of snaps, a plurality of hooks, a strip of velcro, and so on.

The present invention may further comprise a plurality of handles 23. Each of the plurality of handles 23 is clearly shown in FIG. 1. The plurality of handles 23 allows a user to easily grip the present invention and maneuver the present invention wherever the user wishes. The plurality of handles 23 is peripherally positioned about the cushioning layer 4. Each of the plurality of handles 23 is laterally fixed to the enclosing cover 1. This arrangement of the plurality of handles 23 allows the user to grasp onto and maneuver the present invention without any loose items on top of the enclosing cover 1 from falling off the present invention. In the preferred embodiment of the present invention, the plurality of handles 23 is evenly distributed about the cushioning layer 4.

Figure 6:
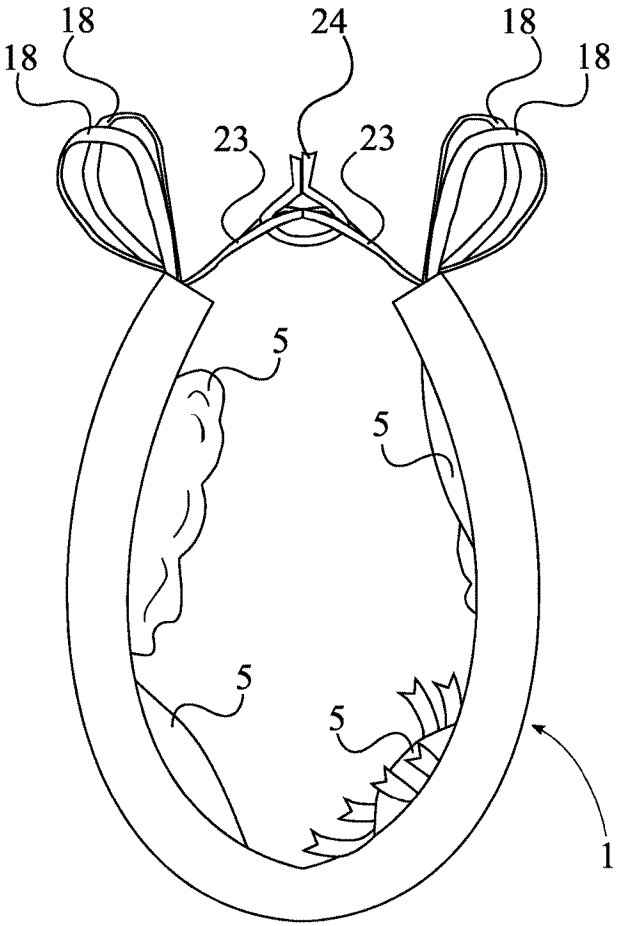
FIG. 6 is a back side view of the present invention in a rolled configuration.

The present invention may further comprise a handle binder 24. The handle binder 24 prevents the unwanted separation of the plurality of handles 23 while in a rolled configuration. The rolled configuration of the present invention is shown in FIG. 6. The handle binder 24 is also shown retaining the plurality of handles 23 in FIG. 6. More specifically, the plurality of handles 23 is detachably attached to each other by the handle binder 24 so that each of the plurality of handles 23 is no longer flailing about the edges of the cushioning layer 4.

Figure 2:
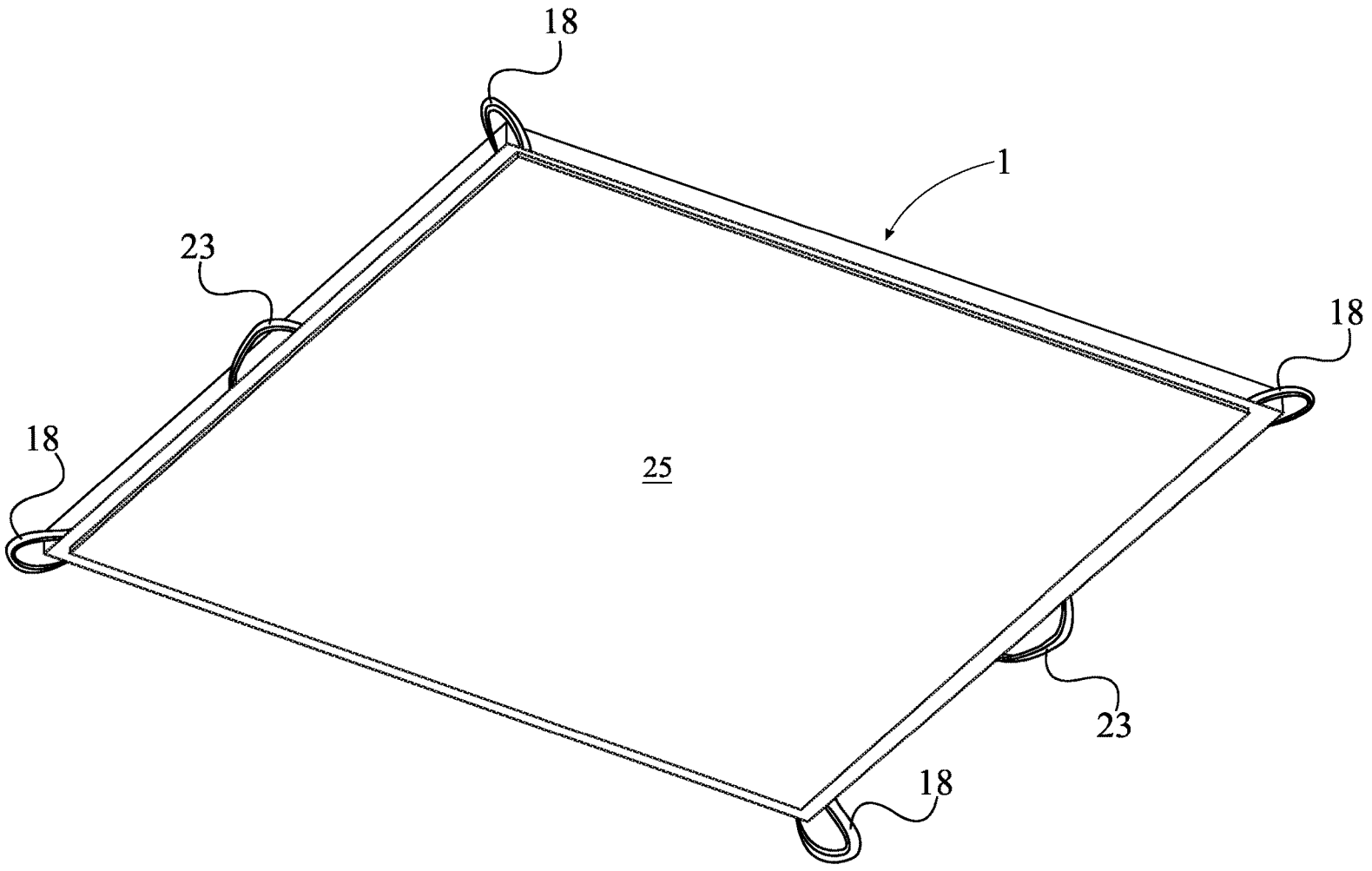
FIG. 2 is a bottom perspective view of an embodiment of the present invention that comprises a plurality of anti-slip feet.
Figure 3:
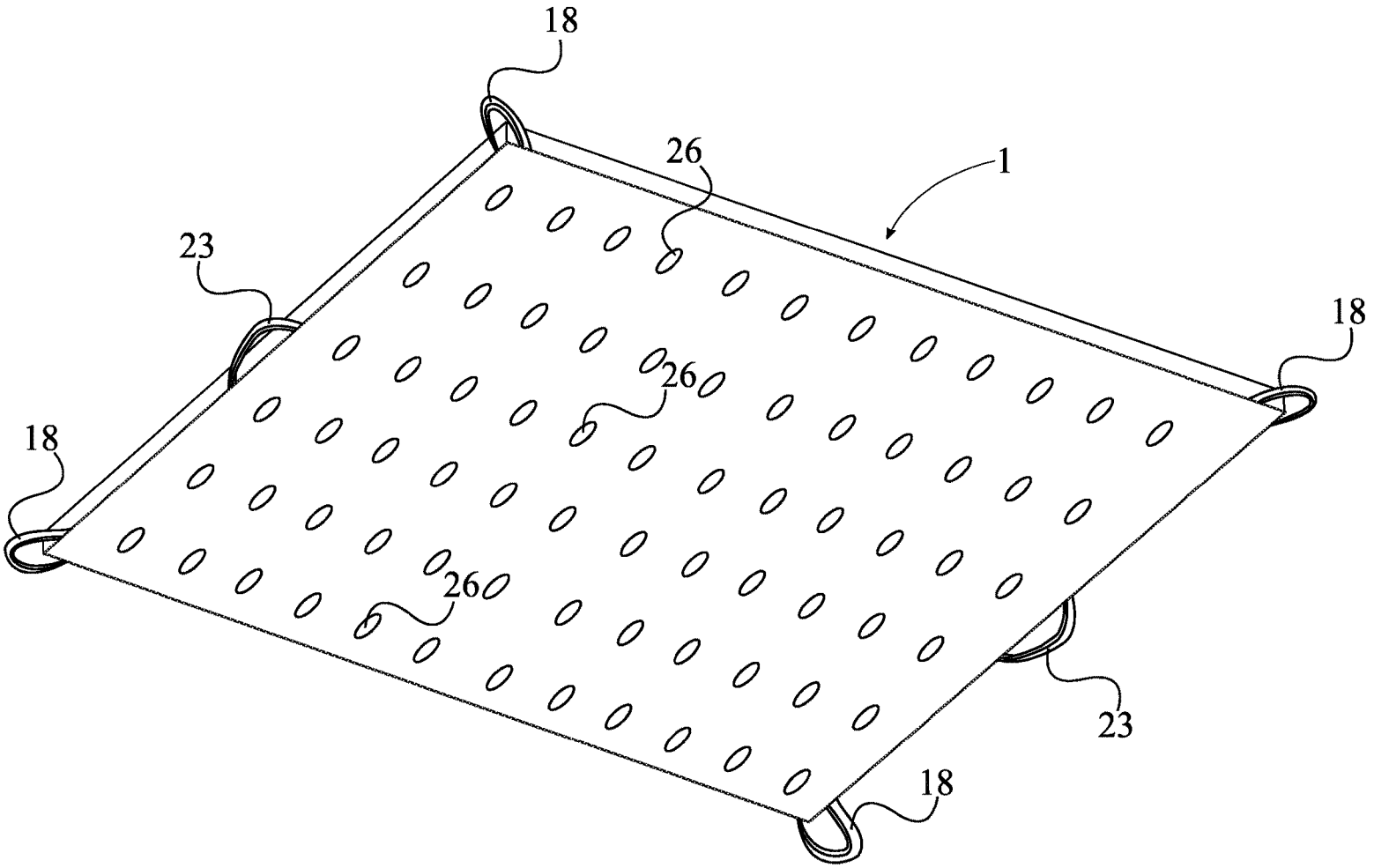
FIG. 3 is a bottom perspective view of an embodiment of the present invention that comprises an anti-slip layer.

An embodiment of the present invention further comprises a plurality of anti-slip feet 26, which is illustrated in FIG. 3. The plurality of anti-slip feet 26 increases the friction between the present invention and the ground beneath the present invention. The plurality of anti-slip feet 26 is distributed across the lower layer 3 and is connected exterior to the lower layer 3, as shown in FIG. 2. The distribution of the plurality of anti-slip feet 26 about the exterior surface of the lower layer 3 secures the position of the present invention. An alternate embodiment of the present invention comprises an anti-slip layer 25 in order to better ensure the position of the present invention. The anti-slip layer 25 is positioned across the lower layer 3 and is connected exterior to the lower layer 3. This arrangement is illustrated in the bottom perspective view of FIG. 3. The configuration between the anti-slip layer 25 and the lower layer 3 prevents the lower layer 3 from directly coming into contact with the ground. The anti-slip layer 25 increases the friction between the present invention and the ground more than that between the exterior of the lower layer 3.

Although the invention has been explained in relation to its preferred embodiment, it is to be understood that many other possible modifications and variations can be made without departing from the spirit and scope of the invention as hereinafter claimed.

What is claimed is:

1. A cushioning choke-safe play mat comprising:
an enclosing cover;
a cushioning layer;
a plurality of toys;
a plurality of handles;
a handle binder;
the enclosing cover comprising an upper layer and a lower layer;
the upper layer and the lower layer being perimetrically connected to each other;
the cushioning layer being positioned within the enclosing cover;
the cushioning layer being superimposed onto the lower layer;
the upper layer being superimposed onto the cushioned layer;
the plurality of toys being fixed exterior and across the upper layer;
each of the plurality of handles being peripherally positioned about the cushioning layer;
each of the plurality of handles being laterally fixed to the enclosing cover;
the plurality of handles being evenly distributed about the cushioning layer; and
the plurality of handles being detachably attached to each other by the handle binder.

2. The cushioning choke-safe play mat as claimed in claim 1 comprising:
the plurality of toys comprising at least one stuffed toy;
the at least one stuffed toy comprising a main cover and a main filling;
the main cover being perimetrically connected to the upper layer; and
the main filling being positioned in between the main cover and the upper layer.

3. The cushioning choke-safe play mat as claimed in claim 2 comprising:
the at least one stuffed toy comprising an at least one secondary feature;
the at least one secondary feature comprising a secondary cover and a secondary filling;
the secondary cover enclosing the secondary filling;
the secondary cover being positioned adjacent to the main cover; and,
the secondary cover being fixed onto the upper layer.

4. The cushioning choke-safe play mat as claimed in claim 2 comprising:
the at least one stuffed toy comprising an at least one secondary feature;
the at least one secondary feature comprising a flaccid member;
a proximal end of the flaccid member being positioned adjacent to the main cover; and
the secondary cover being fixed onto the upper layer.

5. The cushioning choke-safe play mat as claimed in claim 1 comprising:
the plurality of toys comprising at least one squeaky toy;
the at least one squeaky toy comprising a main cover and a press-activated sound-emitted device;
the main cover being perimetrically connected to the upper layer; and,
the press-actuated sound-emitted device being positioned in between the main cover and the upper layer.

6. The cushioning choke-safe play mat as claimed in claim 5 comprising:
the at least one squeaky toy comprising an at least one secondary feature;
the at least one secondary feature comprising a secondary cover and a secondary filling;
the secondary cover enclosing the secondary filling;
the secondary cover being positioned adjacent to the main cover; and
the secondary cover being fixed onto the upper layer.

7. The cushioning choke-safe play mat as claimed in claim 5 comprising:
the at least one squeaky toy comprising an at least one secondary feature;
the at least one secondary feature comprising a flaccid member;
a proximal end of the flaccid member being positioned adjacent to the main cover; and
the secondary cover being fixed onto the upper layer.

8. The cushioning choke-safe play mat as claimed in claim 1 comprising:
the plurality of toys comprising at least one squeaky toy;
the at least one squeaky toy comprising a main cover and a press-activated sound-emitted device;
the main cover enclosing the press-activated sound-emitting device; and
the main cover being hingedly connected to the upper layer.

9. The cushioning choke-safe play mat as claimed in claim 8 comprising:
the at least one squeaky toy comprising an at least one secondary feature;
the at least one secondary feature comprising a secondary cover and a secondary filling;
the secondary cover enclosing the secondary filling;
the secondary cover being positioned adjacent to the main cover; and
the secondary cover being fixed onto the upper layer.

10. The cushioning choke-safe play mat as claimed in claim 8 comprising:

the at least one squeaky toy comprising an at least one secondary feature;

the at least one secondary feature comprising a flaccid member;

a proximal end of the flaccid member being positioned adjacent to the main cover; and the secondary cover being fixed onto the upper layer.

11. The cushioning choke-safe play mat as claimed in claim 1 comprising:

the plurality of toys comprising at least one frilly toy;

the at least one frilly toy comprising a plurality of strips;

the plurality of strips being arranged in an aesthetic configuration; and a proximal end for each of the plurality of strips being fixed onto the upper layer.

12. The cushioning choke-safe play mat as claimed in claim 1 comprising:

a plurality of loops;

each of the plurality of loops being peripherally positioned about the cushioning layer; and each of the plurality of loops being laterally fixed to the enclosing cover.

13. The cushioning choke-safe play mat as claimed in claim 12 comprising:

the plurality of loops being evenly distributed about the cushioning layer.

14. The cushioning choke-safe play mat as claimed in claim 1 comprising:

the enclosing cover comprising an elongated opening and an elongated fastener;

the elongated opening comprising a first lengthwise edge and a second lengthwise edge;

the elongated opening being positioned in between the upper layer and the lower layer; and, the first lengthwise edge and the second lengthwise edge being attached along each other by the elongated fastener.

15. The cushioning choke-safe play mat as claimed in claim 1, wherein the cushioning layer is made of a low resilience polyurethane foam material.

16. The cushioning choke-safe play mat as claimed in claim 1 comprising:

a plurality of anti-slip feet;

the plurality of anti-slip feet being distributed across the lower layer; and the plurality of anti-slip feet being connected exterior to the lower layer.

17. The cushioning choke-safe play mat as claimed in claim 1 comprising:

an anti-slip layer;

the anti-slip layer being positioned across the lower layer; and the anti-slip layer being connected exterior to the lower layer.

* * * * *